US009947257B2

(12) United States Patent
Broughton et al.

(10) Patent No.: US 9,947,257 B2
(45) Date of Patent: Apr. 17, 2018

(54) PIXEL LAYOUT AND DISPLAY WITH VARYING AREA AND/OR LUMINANCE CAPABILITY OF SAME TYPE SUB-PIXELS IN DIFFERENT COMPOSITE PIXELS

(71) Applicant: Sharp Kabushiki Kaisha, Osaka (JP)

(72) Inventors: Benjamin John Broughton, Oxford (GB); Nathan James Smith, Oxford (GB); Edward Heywood-Lonsdale, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 310 days.

(21) Appl. No.: 14/808,228

(22) Filed: Jul. 24, 2015

(65) Prior Publication Data

US 2017/0025053 A1 Jan. 26, 2017

(51) Int. Cl.

| | |
|---|---|
| ***G09G 3/36*** | (2006.01) |
| ***G09G 3/20*** | (2006.01) |
| ***G09G 3/3208*** | (2016.01) |

(52) U.S. Cl.

CPC ..... *G09G 3/2003* (2013.01); *G09G 3/3208* (2013.01); *G09G 3/3607* (2013.01); *G09G 3/3648* (2013.01); *G09G 2300/0452* (2013.01); *G09G 2320/0233* (2013.01); *G09G 2320/0242* (2013.01); *G09G 2340/0457* (2013.01)

(58) Field of Classification Search

CPC ..... H01L 27/3216; G09G 2300/0443; G09G 2300/0452; G09G 2320/0242; G09G 2320/028; G09G 2340/0457; G09G 3/3607; G09G 3/36; G09G 5/00; G09G 3/10; G11C 19/00; G02F 1/1345; G06F 3/038; G02B 27/22

See application file for complete search history.

(56) References Cited

U.S. PATENT DOCUMENTS

| | | | | |
|---|---|---|---|---|
| 5,905,482 | A | 5/1999 | Hughes et al. | |
| 6,867,549 | B2 * | 3/2005 | Cok | G09G 3/3216 315/169.3 |
| 7,646,398 | B2 | 1/2010 | Brown Elliott | |
| 8,354,789 | B2 | 1/2013 | Kim et al. | |
| 8,817,056 | B2 | 8/2014 | Park | |
| 2002/0167477 | A1 * | 11/2002 | Tsutsui | G09G 3/3648 345/89 |

(Continued)

*Primary Examiner* — Pegeman Karimi

(74) *Attorney, Agent, or Firm* — Renner, Otto, Boisselle & Sklar, LLP

(57) ABSTRACT

A color display includes multiple composite pixels, each composite pixel including sub-pixels of more than one color type. Sub-pixels of at least one of the color types are provided with differing luminance capability in different composite pixels. Each composite pixel may include red, green and blue sub-pixels having different luminance capability in different composite pixels. The differing luminance capability may be achieved by providing sub-pixels of at least one of the color types of differing relative area. An image data processing unit (IDPU) receives input image data of a standard format, and modifies the input image data into output image data for display to account for a discrepancy between the luminance capability based on the differing luminance capability or differing size of each sub-pixel, and a luminance capability as expected based on the input image data. The IDPU then outputs the output image data to control the composite pixels.

4 Claims, 9 Drawing Sheets

(56) References Cited

U.S. PATENT DOCUMENTS

| | | | | |
|---|---|---|---|---|
| 2006/0158466 | A1* | 7/2006 | Chien | G09G 3/2074 345/694 |
| 2007/0002084 | A1* | 1/2007 | Kimura | G09G 3/3241 345/694 |
| 2008/0042942 | A1* | 2/2008 | Takahashi | G09G 3/207 345/77 |
| 2008/0074414 | A1* | 3/2008 | Park | G09G 3/2003 345/213 |
| 2008/0272998 | A1* | 11/2008 | Yano | G09G 3/2051 345/89 |
| 2009/0167779 | A1* | 7/2009 | Inuzuka | G09G 3/2003 345/589 |
| 2010/0109992 | A1* | 5/2010 | Sumi | G09G 3/3648 345/89 |
| 2010/0309298 | A1* | 12/2010 | Muijs | G09G 3/3406 348/59 |
| 2013/0106891 | A1* | 5/2013 | Matsueda | G09G 3/2003 345/589 |
| 2016/0267685 | A1* | 9/2016 | Yang | G09G 3/2003 |
| 2016/0335741 | A1* | 11/2016 | Zhao | G06T 3/40 |
| 2016/0343313 | A1* | 11/2016 | Ji | G09G 3/36 |
| 2017/0025052 | A1* | 1/2017 | Lin | G09G 3/2003 |

* cited by examiner

Figure 5

| Normalised On-Axis Luminance | Small (1/7th Pixel area) sub-pixel normalised luminance | Medium (2/7th Pixel area) sub-pixel normalised luminance | Large (4/7th Pixel area) sub-pixel normalised luminance |
|---|---|---|---|
| 0 | 0 | 0 | 0 |
| 1/7th | 1 | 0 | 0 |
| 2/7th | 0 | 1 | 0 |
| 3/7th | 1 | 1 | 0 |
| 4/7th | 0 | 0 | 1 |
| 5/7th | 1 | 0 | 1 |
| 6/7th | 0 | 1 | 1 |
| 7/7th | 1 | 1 | 1 |

PIXEL LAYOUT AND DISPLAY WITH VARYING AREA AND/OR LUMINANCE CAPABILITY OF SAME TYPE SUB-PIXELS IN DIFFERENT COMPOSITE PIXELS

TECHNICAL FIELD

The invention relates to pixel layouts and displays such as those within the field of consumer electronic displays, and particularly high resolution, transmissive, colour mobile displays in which spatial resolution has increased beyond visible limits and may therefore be compromised to improve other display metrics or add functionality.

BACKGROUND ART

The vast majority of colour electronic displays, including transmissive (such as liquid crystal display (LCD)), emissive (such as organic light-emitting diode (OLED)) and reflective (such as electrophoretic) types, use three or more different colour type sub-pixels within each display pixel, in order to be able to show a composite colour from each pixel unit with a high degree of control of both chromaticity and luminance. This is achieved by independently modulating the amount of light transmitted, reflected or emitted by each of the colour-type sub-pixels comprising a pixel to produce the intended additive colour mixture. In the most common display type, a transmissive LCD, each composite display pixel comprises a red (R), green (G) and blue (B) sub-pixel. These sub-pixels are arranged in a vertical stripe pattern, each sub-pixel having an area of approximately one-third of the composite pixel area, and a rectangular shape with 3:1 aspect ratio, so that the composite pixel has a square geometry providing equal image resolution (both black/white and colour resolution) in the horizontal and vertical directions. (See, e.g., FIG. 1(*a*)).

Several types of display devices are known which utilise different areas and/or shapes for the different sub-pixels. Prominent examples include the "Pentile RGBG" and "Samsung RGBG" pixel layouts used in OLED displays, in which the green sub-pixels are smaller than the R and B sub-pixels in all the pixels. (See, e.g., FIGS. 1(*b*) and 1(*d*)). This is done for reasons of equalising the emissive lifetime of the different electroluminescent materials used in the different colour types. These display types also may have sub-pixels of different colour types within each composite pixel, each composite pixel comprising a G sub-pixel and either an R or B sub-pixel. This is done for reasons of exploiting the human visual system's (HVS) reduced acuity at red and blue wavelengths to minimise the total number of sub-pixels required to faithfully display an image. These layouts are disclosed in U.S. Pat. No. 6,867,549 B2 (Cok et al., issued Mar. 15, 2005) and U.S. Pat. No. 8,354,789 B2 (Gun-Shik et al., issued Jan. 15, 2013).

As image data content in all common formats is almost exclusively configured for display on devices with R, G and B sub-pixels, and therefore assumes each pixel of the display is capable of displaying any mixture of R, G and B, including black and white, displays of this type are usually configured with a built-in image processing function to reconfigure the input data for display on the particular device. This enables the display to optimally transfer luminance intended for the red sub-pixel of a pixel, for example, from a composite pixel which has no red sub-pixel, to a neighbouring one which does, with minimal impact on the perceived image quality in terms of sharpness or colour fidelity (U.S. Pat. No. 8,817,056 B2, Jong-Woong et al., issued Aug. 26, 2014).

Similarly, pixel layouts using multiple sub-pixels of one or more colour type, in conjunction with only one of another colour type, to better match the HVS colour resolution, or allow improved image appearance via sub-pixel rendering methods, have been disclosed in U.S. Pat. No. 7,646,398 B2 (Brown Elliot, issued Jan. 12, 2010).

Displays in which each composite pixel comprises one of each type of colour sub-pixel utilised in the display, but in which the different colour type sub-pixels within the composite pixel are provided with different relative areas are known. Examples include Sharp Electronics Corporation's Quattron™ RGBY type display, in which each pixel has four sub-pixels, the G and Y type sub-pixel having a smaller area than the R and B types. (See, e.g., FIG. 1(*c*)). This is done for reasons of maintaining a balanced white colour when all the sub-pixels are made fully transmissive.

Displays having pixels of only a single colour type (e.g. transparent), for use with time sequential coloured backlight illumination, in which the sub-pixels within a pixel are different sized, so as to enable temporal and spatial dither of pixels which are only capable of a binary transmission control, are known, for example, U.S. Pat. No. 5,905,482 (Hughes et al., issued May 18, 1999).

However, all of these methods either have only one type of colour sub-pixel with binary transmission control, or retain a fixed area for all the sub-pixels of a given type within the display. Therefore, while they are able to trade-off resolution in a particular colour channel for a reduced number of pixels overall, or they may optimally utilise the available display area to provide the intended white hue when all pixels are maximally bright, they are not able to trade off resolution within a single colour channel for increased bit-depth, improved wide-view performance, response time or other display metrics which may be improved by providing an increased number of average luminance gradations from a group of same colour-type but differing area sub-pixels, using a fixed number of voltage or current addressing gradations. Nor are they able to provide multiple configurations of pixel luminances within a group of same colour-type but differing area sub-pixels, while maintaining a fixed overall luminance, thereby allowing sub-pixel rendering within a single colour channel, improved wide-view performance, or other display metrics.

SUMMARY

In view of the aforementioned shortcomings associated with conventional displays, there is a strong need for a colour display with enhanced display performance as compared to conventional configurations. To achieve enhanced performance, the present invention includes a colour display and related image data processing method in which different sub-pixels of the same colour type occupy different areas or otherwise have different luminance capabilities in different composite pixels, thereby, in combination with an input image data processing function, allowing an aspect of the displays performance to be improved.

As aspect of the invention, therefore, is a color display. In exemplary embodiments, the color display includes a plurality of composite pixels, each composite pixel comprising sub-pixels of more than one color type. Sub-pixels of at least one of the color types are provided with differing luminance capability in different composite pixels. For example, the differing luminance capability is achieved by providing sub-pixels of at least one of the color types of differing relative area in different composite pixels.

The color display further may include an image data processing unit (IDPU), which may constitute a processor device that is configured to perform a related method of processing image data in a color display. The IDPU may be configured to receive input image data of a standard format, modify the input image data into output image data to account for a discrepancy between the luminance capability of each sub-pixel and a luminance capability for each sub-pixel as expected based on the input image data, and output the output image data to control the plurality of the composite pixels. As referenced above, the differing luminance capability by may achieved by providing sub-pixels of different color type of differing relative areas in different composite pixels. The IDPU may be configured, as part of the processing method, to transfer luminance between sub-pixels to account for the luminance discrepancy. In exemplary embodiments, the processing method may include transferring excess luminance from lower luminance or smaller area sub-pixel types to their immediate neighbour larger luminance or larger area sub-pixel types.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, like references indicate like parts or features:

FIG. 5: is a table detailing the driving conditions different sized sub-pixels of a display of the type exemplified in FIG. 2 in order to achieve zero off-axis luminance error at eight on-axis luminance values;

DETAILED DESCRIPTION

An aspect of the invention is a colour display. In exemplary embodiments, the colour display includes a plurality of composite pixels, each composite pixel comprising sub-pixels of more than one colour type. Sub-pixels of at least one of the colour types are provided with differing luminance capability in different composite pixels. In a principal embodiment, the differing luminance capability is achieved by providing sub-pixels of at least one of the colour types of differing relative area in different composite pixels.

Figure 1:
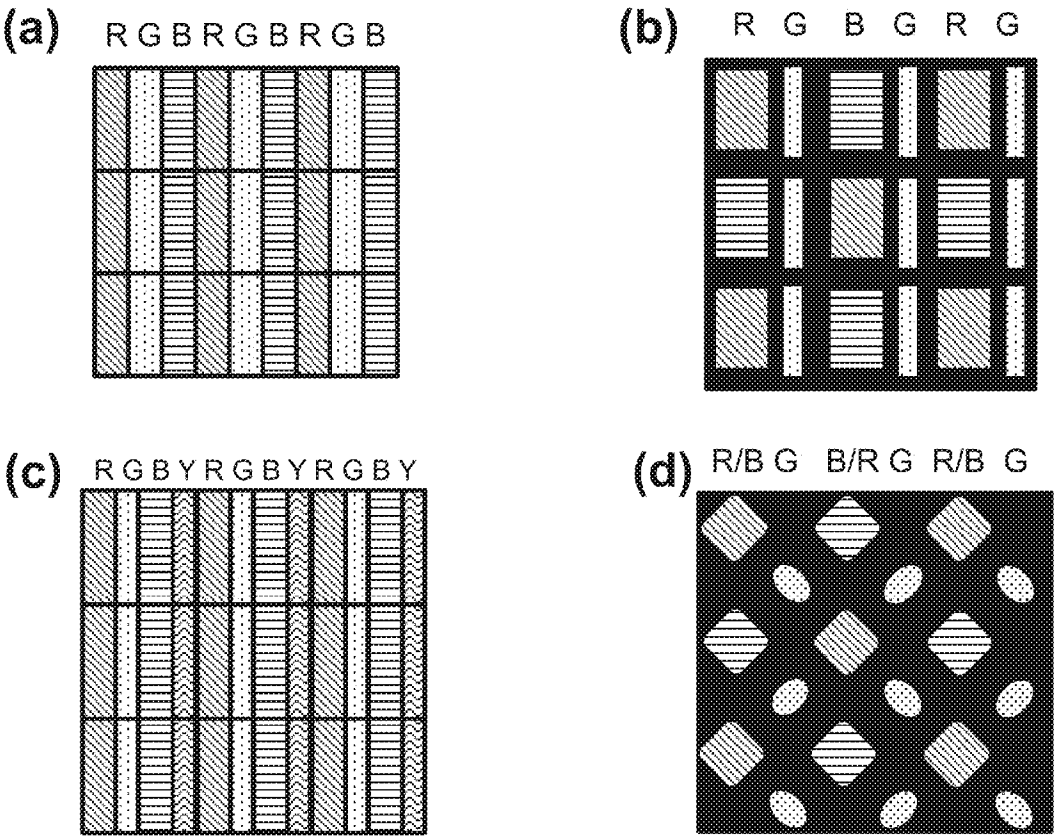
Figure 1 (Conventional Art)
FIG. 1(*a*), FIG. 1(*b*), FIG. 1(*c*), and FIG. 1(*d*): are illustrations of conventional display pixel layouts, all having equal area of like-coloured sub-pixels.

In a first exemplary embodiment, a transmissive type LCD is modified from the standard RGB stripe pixel configuration, in which each composite white pixel is vertically divided into three sub-pixels of equal width (as illustrated in FIG. 1(*a*), by alternating the relative area occupied by each sub-pixel colour type within a pixel in both the horizontal and vertical directions between three different area sizes. The area occupied by each white pixel, its shape, and the number and type of colour sub-pixels may be left unchanged by providing one of each colour type sub-pixel, and one of each area ratio, within each white composite pixel.

Figure 2:
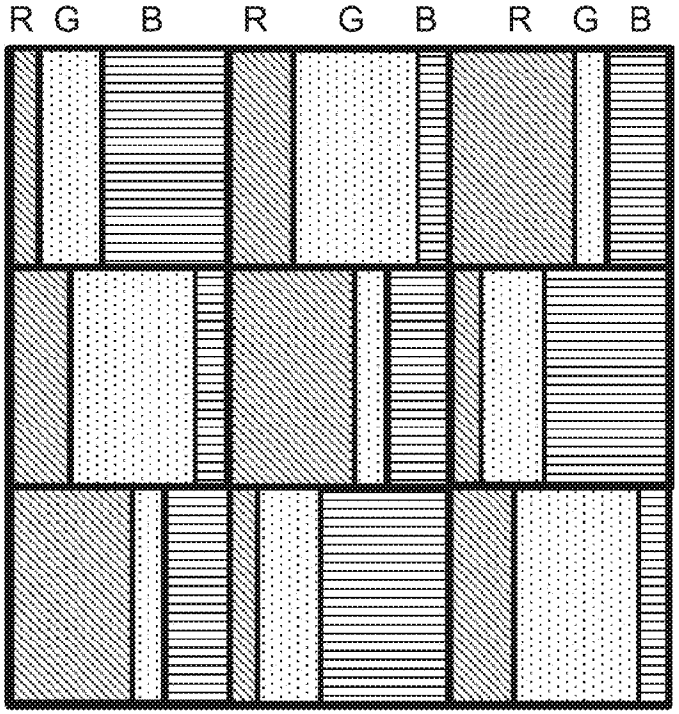
FIG. 2: is an illustration of a pixel layout in accordance with an exemplary embodiment of the present invention.

The area ratio of the three sub-pixels in any composite pixel may be modified from the standard $1/3^{rd}$ of the available transmissive area for each sub-pixel, to one sub-pixel each of $1/7^{th}$, 2/7ths and 4/7ths of the available transmissive area, for example. For the purposes of this description, the available transmissive area may be taken to be the area of the composite pixel minus the area required for non-transmissive pixel elements such as wiring lines and transistors of the active matrix backplane, and black masked regions of the colour filter required for pixel separation and covering non-switching regions. Thereby, three sub-pixel area types are provided for each colour type with relative areas of area ratio 1, 2 and 4 sevenths of the total pixel area. Accordingly, each composite pixel is provided with one sub-pixel of each of the colour types, and one sub-pixel of each of the relative areas, such that each composite pixel has a same total area. In addition, across neighbouring pixels the sub-pixels of a given colour type in groups of three neighbouring pixels also having relative areas of area ratio 1, 2 and 4. An example of such a pixel layout is illustrated in FIG. 2.

In a standard LCD, each sub-pixel is driven with a typically 8 bit signal voltage. Each sub-pixel is thereby capable of being set to produce one of 256 different transmission levels. As the overall colour produced by the composite pixels is determined by the additive contribution of the three sub-pixels (R, G and B), each pixel is capable of displaying 256^3=16,777,216 million different colour combinations. This has been sufficient to adequately utilise the image display capability of the LCD hardware up until recently, with the difference in luminance or colour between areas of the display addressed with data differing by only a single gradation being barely perceptible, when the gradations are set to span the dynamic range (i.e. the full range between the darkest and brightest possible displayed values) of the display hardware. This ensures "contouring" of what should appear to be smoothly varying areas of colour is not generally detectable. Modern LCD displays however are capable of extremely high contrast ratios, and very high maximum luminance values, especially when combined with image content dependent active backlight control, and hence have greatly expanded dynamic range. These displays can therefore exhibit visible contouring of 8 bit depth image data, and for optimal utilisation of the display dynamic range, require image data of higher bit-depth (i.e. a greater number of transmission gradations for each sub-pixel) for example 10 or 12 bit image data, in order to make single gradation value changes in the image imperceptible.

Modern LCD displays, particularly for mobile applications such as tablet computers and smartphones, are also now capable of extremely high spatial resolutions. In 2006, Sharp Kabushiki Kaisha released the Sharp 904sh phone for Softbank with a 333 pixels per inch (ppi) display. In 2010, Apple then marketed the iPhone4®, with a 326 ppi display, as having a "retina" display, i.e. having a pixel resolution that exceeded the human eye's ability to discern the smallest displayable features at the intended viewing distance. In 2015, Samsung has announced the Galaxy S6® smartphone will have a display pixel density of 577 ppi. This higher than typically resolvable spatial resolution opens up the possibility of using groups of multiple neighbouring pixels to display an average luminance with higher effective bit-depth than each sub-pixel may be addressed with individually, without the resultant effective resolution loss being visible to the user. However, the typical display pixel layout of equal sized sub-pixels of a given colour type does not allow optimal utilisation of this trade-off. For example, if a group of three neighbouring sub-pixels of a given colour type, with the standard equal area and 8 bit gradation control, are effectively grouped in order to provide an average overall luminance, then in total 256+255+255=766 different gradations for the group are available. If the three sub-pixels have area ratios of 1, 2 and 4 respectively as provided by the exemplary embodiment of FIG. 2, then the total number of overall luminance gradations provided by the group is (256×1)+(254×2)+(254×4)=1786 gradations.

Varying the relative size of the sub-pixels thereby increases the maximum displayable bit depth of the display, using 3 pixel averaging, from greater than 9 bit, to greater than 10 bit gradation fineness. In each case, the size of a composite white sub-pixel is the same, and the same number of pixels are used in the averaging process to increase the effective bit-depth, so the effective resolution loss in the trade-off to increase bit-depth is the same. The change to sub-pixels of differing area according to this embodiment thereby increases the number of displayable average gradations for a three pixel group of like colour sub-pixel types by a factor of 2.3, at no detriment to display performance in other metrics.

In a further embodiment, the pixel layout of FIG. 2 is used to improve the wide-view performance of a display, rather than the effective bit depth. In transmissive LCDs, the normalised (i.e. relative to maximum) luminance observed by an off-axis viewer (i.e. positioned at an angle to the display normal) for some image input gradation levels is commonly different to that observed by the on-axis viewer. This off-axis luminance error is particularly large in twisted nematic (TN mode) and vertically aligned (VA mode) LCDs, and can result in a washed-out, overly dark, or erroneously coloured off-axis image appearance.

Figure 3:
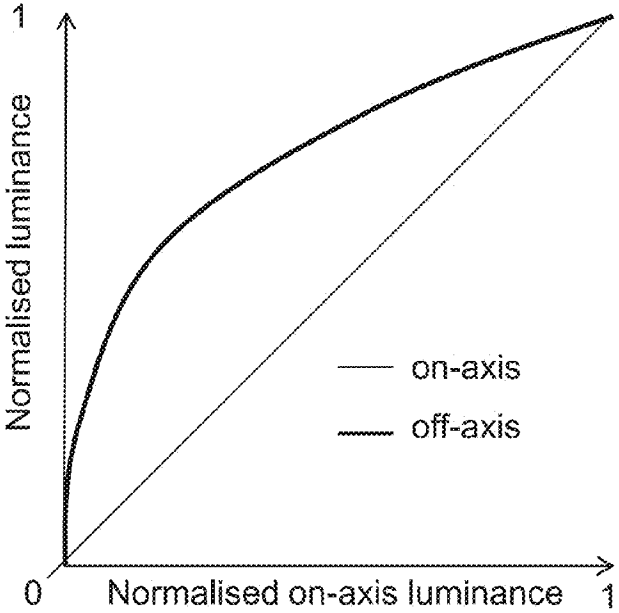
Figure 3 (Conventional Art)
FIG. 3: is a plot of the typical off-axis to on-axis normalised luminance of a conventional type of LCD.

FIG. 3 illustrates the off-axis to on-axis normalised luminance error of a typical VA mode LCD, for all on-axis luminances. It can be seen from FIG. 3 that the fully black and fully white states produce the correct normalised luminance off-axis, but all mid-grey luminance levels are excessively bright. This causes colour shift with viewing angle, and a washed out image appearance. Methods for trading off display resolution in order to allow image data modifications which share the intended luminance for a given image region among groups of two or more neighbouring pixels, and configure the individual data values of those pixels to minimise the occurrence of mid-grey data levels, and thereby improve the wide-view performance of the display are given in U.S. Pat. No. 6,801,220 (Greier et al., issued Oct. 5, 2004) and U.S. Pat. No. 8,508,449 B2 (Broughton et al., issued Aug. 13, 2013). However, in the methods previously disclosed, due to the pixels comprising the group within which luminance is redistributed from the input image data all having equal area, the amount of wide-view performance improvement is not maximised for the amount of effective resolution loss.

Figure 4:
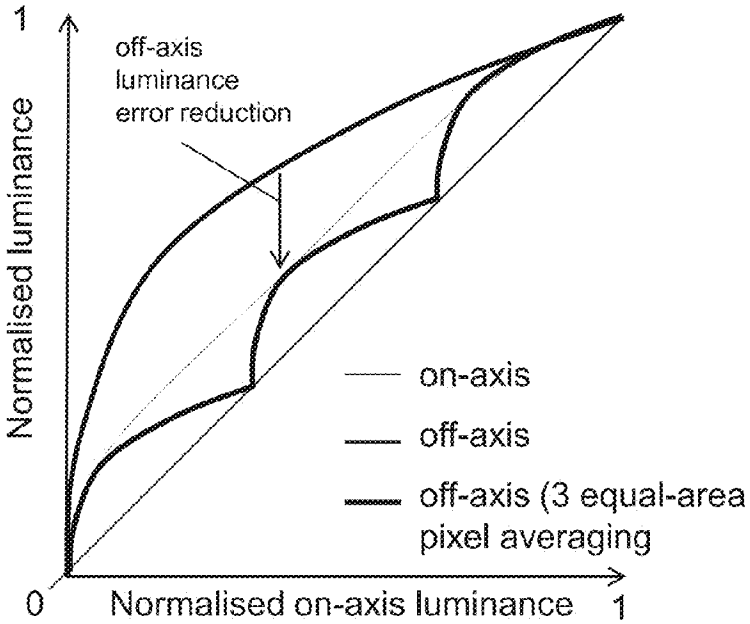
FIG. 4: is a plot illustrating how the display characteristic of FIG. 3 may be modified by averaging luminance over groups of three equal size or luminance capability pixels.

FIG. 4 illustrates how the effective off-axis to on-axis normalised luminance error of the display of FIG. 3 may be reduced by using the average luminance produced by groups of three pixels of equal size or luminance capability to represent an image, rather than the individual pixel luminances specified by the input data. It can be seen that a significant reduction in the error is achieved, and the error is reduced to zero for on-axis luminance values of ⅓rd and ⅔rds of the maximum. This is because for input image data specifying pixels at ⅓rd of maximum luminance, instead of using three pixels each at ⅓ of maximum, a single pixel is set to full brightness, and the remaining two pixels of the group are set to minimum brightness. As all the pixels of the group are set to maximum or minimum brightness, and the display exhibits no off-axis luminance error at these values, the off-axis luminance error is eliminated. Likewise, for a target of $\frac{2}{3}^{rd}$ of maximum brightness for the three pixel group, two pixels are operated at maximum, and one at minimum brightness. In practice, the actual pixel data values may not be modified to this extent, in order to maintain a smooth off-axis to on-axis luminance curve at the expense of some absolute error (the dotted line in FIG. 4 may be utilised), but the overall extent of the improvement is limited by the size of the error between these zero error values, and the number of on-axis luminance values for which the error can be minimised.

Figure 6:
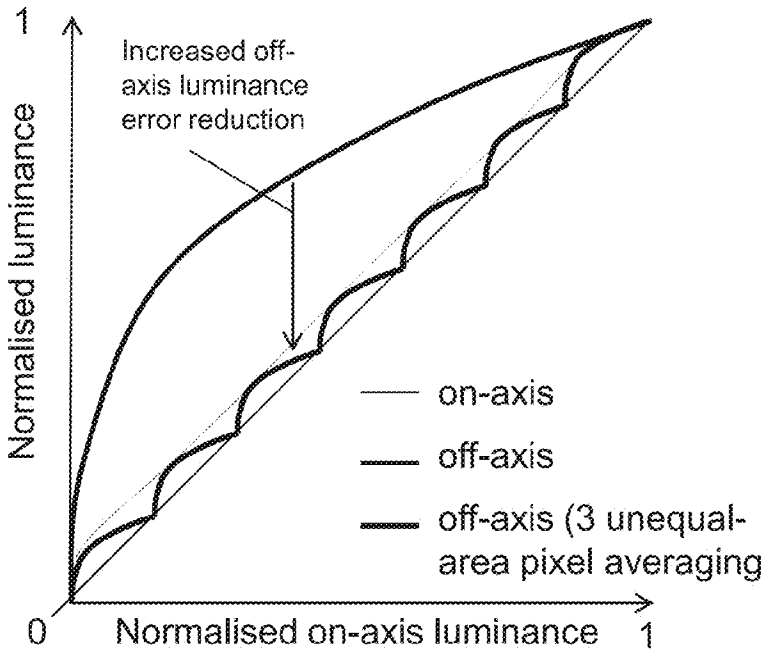
FIG. 6: is a plot illustrating how the display characteristic of FIG. 3 may be modified by averaging luminance over groups of three unequal size or luminance capability pixels.

A display having the same off-axis to on-axis normalised luminance error of that illustrated in FIG. 3, but having the pixel layout in accordance with the embodiment of the present invention shown in FIG. 2, may have the off-axis luminance error eliminated at six intermediate on-axis luminance levels, in addition to the inherent zero error points of minimum and maximum luminance, namely at $\frac{1}{7}^{th}$, ⅔ths, ⅗ths, ⅘ths, $\frac{5}{7}^{ths}$ and ⅙ths of maximum brightness. The individual pixel luminances for a group of three pixels required to produce these average luminance values in combination, are shown in the table of FIG. 5. The resulting improvement in the off-axis luminance error is shown in FIG. 6 (again the actual result may be adjusted to that of the dotted line to improve the smoothness of the off-axis luminance curve). It can be seen that the error is substantially reduced in comparison to that achieved by sharing the luminance with groups of three pixels of equal size, as shown in FIG. 4. As with the first embodiment of this invention, the size of a composite white sub-pixel is the same in both the equal pixel size example of FIG. 4, and the pixel layout of this invention, and the same number of pixels are used in the averaging process to reduce the off-axis luminance error, so the effective resolution loss in the trade-off to increase bit-depth is the same. The change to sub-pixels of differing area according to this embodiment thereby increases the wide view improvement which may be achieved at no detriment to display performance in other metrics.

In a further embodiment, the pixel layout and image data modification methods of the previous embodiments are combined with an image data modification process which minimises the apparent resolution loss caused by the change in pixel layout, and sub-pixel areas, and the bit depth improvement and wide-view improvement image data modifications.

Figure 7:
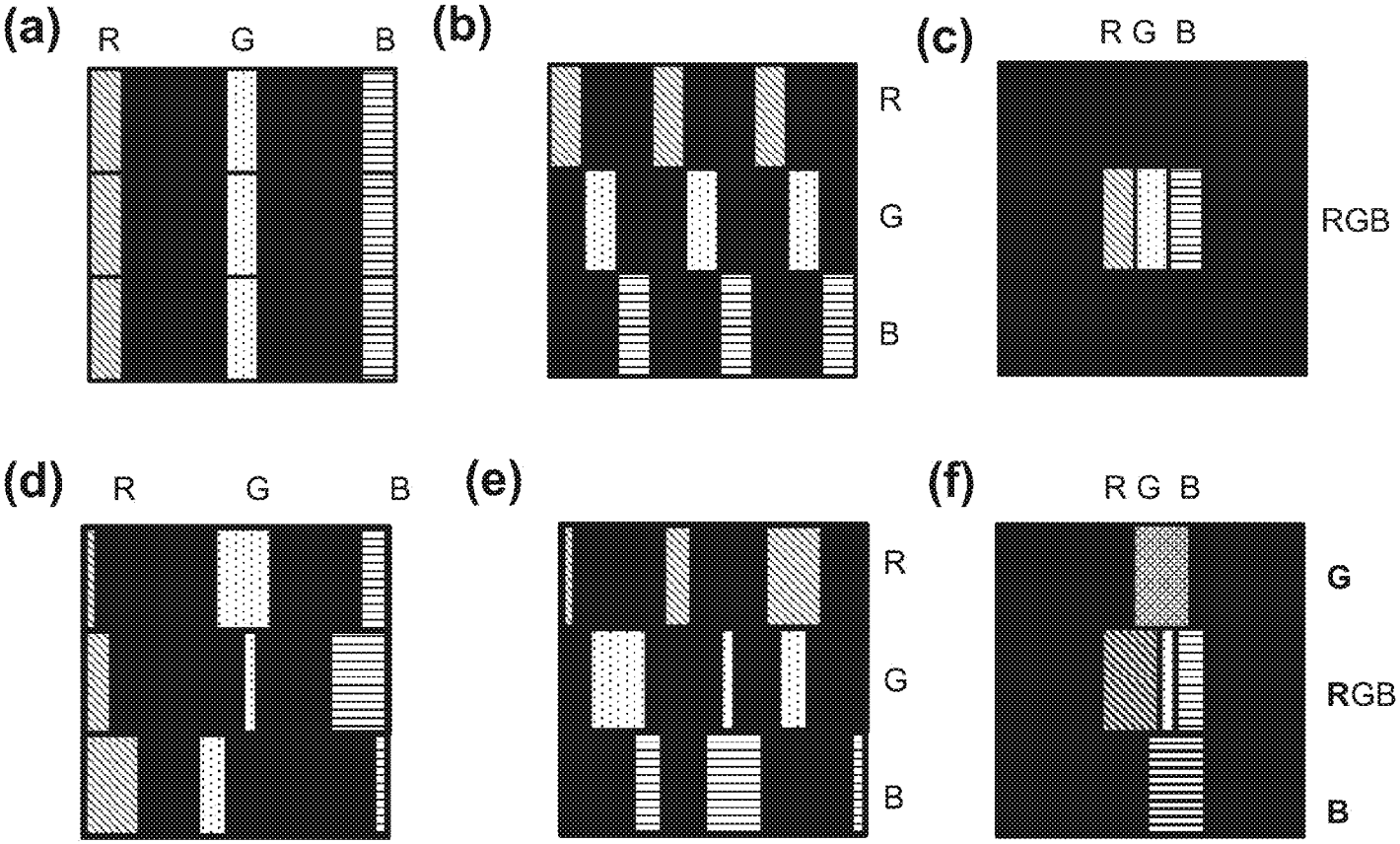
FIG. 7(*a*), FIG. 7(*b*), FIG. 7(*c*), FIG. 7(*d*), FIG. 7(*e*) and FIG. 7(*f*): are illustrations of how three single pixel width feature patterns may be rendered on an RGB stripe display, and on a display in accordance with an exemplary embodiment of the present invention.

FIGS. 7(*d*) and 7(*e*) illustrate that single sub-pixel width horizontal and vertical lines may be displayed using the multiple pixel area layout of this invention without any apparent resolution loss in comparison to the standard RGB stripe layout displaying the same patterns (FIGS. 7(*a*) and 7(*b*), respectively), in the expected case that the display has a sufficiently high pixel density to prevent the different size of the sub-pixel being perceivable. However, FIG. 7(*f*) shows that, due to each composite white pixel no longer being capable of displaying a white colour of the correct chromaticity at full brightness, when the input image data requires this some of the neighbouring sub-pixels of the colour type for which the intended white pixel has smaller than standard sub-pixels (green and blue in the example of the Figure) must also be turned on to some extent, and the larger colour type sub-pixel must have its displayed luminance reduced to balance the relative colour contribution for R, G and B, while maintaining the correct overall luminance. This results in some loss of effective resolution.

Figure 8:
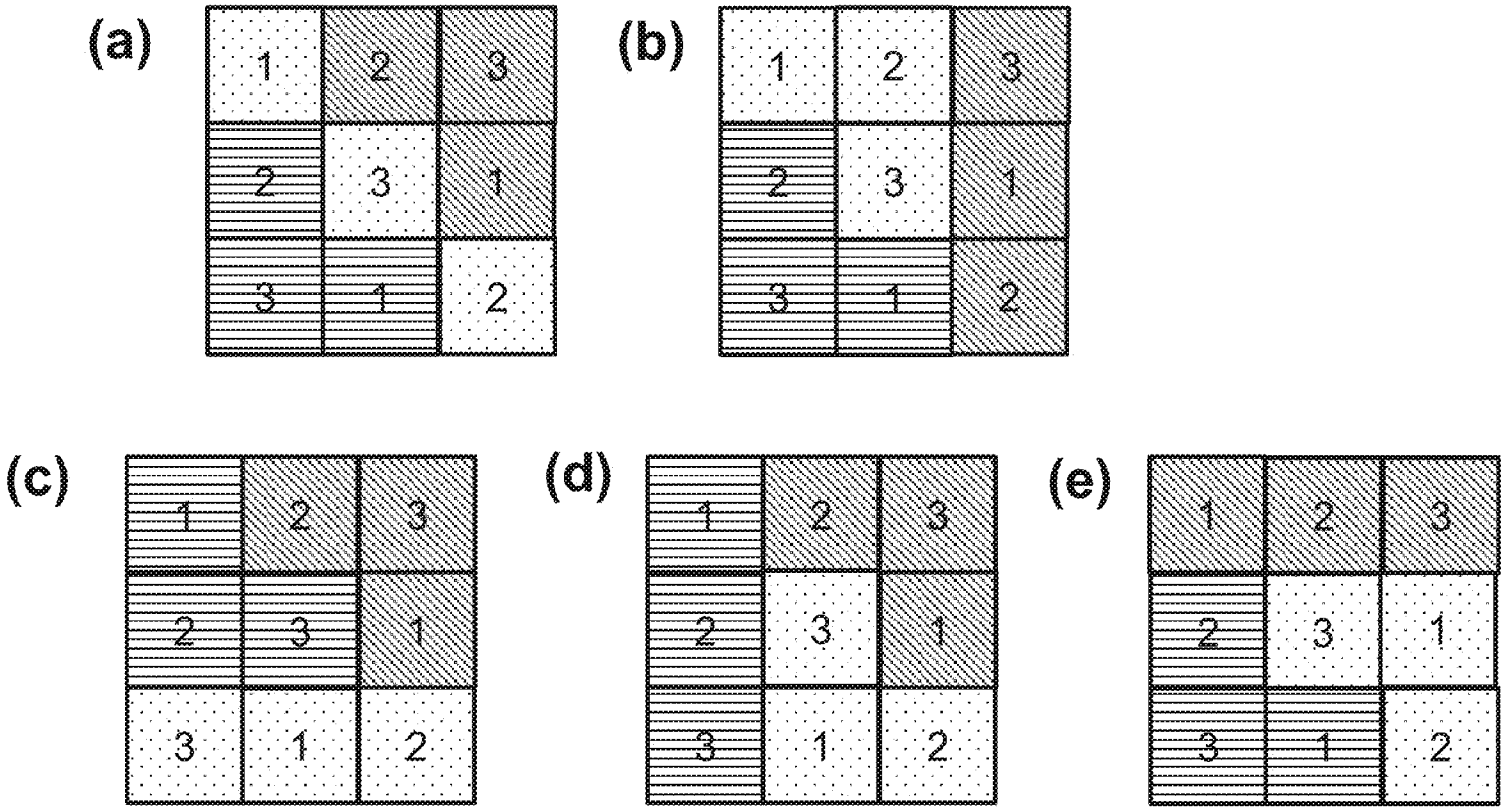
FIG. 8(*a*), FIG. 8(*b*), FIG. 8(*c*), FIG. 8(*d*), and FIG. 8(*e*): are illustrations of five further single pixel width feature patterns which may be rendered on a display in accordance with an exemplary embodiment of the present invention with no effective resolution loss.

However, FIGS. 8(*a*)-8(*e*) respectively illustrate that there are also at least five other sub-pixel luminance patterns in addition to vertical and horizontal stripes) which may be displayed using the pixel layout of FIG. 2 with no effective resolution loss. It can be seen these patterns consist of the configurations with a 3×3 pixel group in which a group of three sub-pixels of any given colour type has one of each sub-pixel area size. In the Figures, the number in each pixel represents the type of composite pixel (1 having a large blue sub-pixel, medium green and small red, 2 having large green, medium red and small blue for example), and the shading represents the input data pattern, which is intended to illustrate groups of pixels of any like composite colour.

Figure 9:
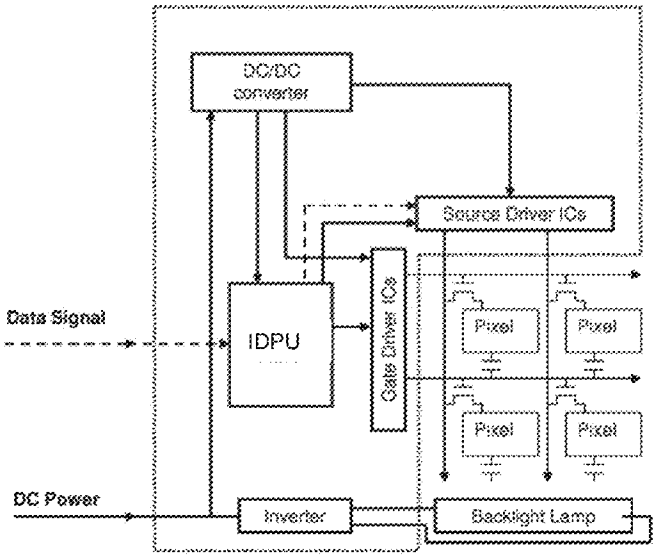
FIG. 9 is a schematic of a standard layout control electronics for a display in accordance with an exemplary embodiment of the invention.

In a further embodiment, therefore, an input image data processing unit (IDPU) may be configured for use with a display of the pixel layout of FIG. 2 as represented in FIG. 9. Referring to FIG. 9, the IDPU may be implemented as an electronic processor as are known in the art. The IDPU may include one or more processor devices such as a microprocessor or CPU, or other hardware circuit or like device with similar processing functionality. The IDPU further may include a non-transitory computer readable medium, such as one or more memories or like data storage devices, that stores executable computer program code incorporating instructions for processing image data which may be executed by the processor device(s) to process image data. In operation, the IDPU is configured to receive input image data, and by executing the program code instructions, to modify the input image data into output image data in a format enhanced for display.

As further detailed below, in exemplary embodiments the IDPU is configured to: receive input image data of a standard format; modify the input image data into output image data to account for a discrepancy between the luminance capability of each sub-pixel capability (which may be based on differing sub-pixel areas) and a luminance for each sub-pixel as expected based on the input image data; and output the output image data to control the plurality of the composite pixels.

In one example of modifying the input image data, the IDPU is configured to modify the input image data by processing groups of pixels in the input image data corresponding to the smallest repeating unit of the pixel pattern of the display together; matching the pattern pixel luminances in the group specified by the input image data to the closest of a set of zero effective resolution loss patterns; and transferring luminance between sub-pixels to account for the luminance discrepancy or differing area in a manner informed by the result of the pattern matching. In another example of modifying the input image data, the IDPU is configured to modify the input image data by processing sub-pixels individually and in sequence, and transferring excess luminance from lower luminance or smaller area sub-pixel types to their immediate neighbour larger luminance or larger area sub-pixel types which are yet to be processed in the sequence, in a manner which accounts for both the discrepancy in the luminance capability or area of each sub-pixel, and in relative luminance capabilities of the sub-pixels between which luminance is transferred.

In exemplary embodiments, the IDPU receives input image data in the standard RGB 3-colour channel format, intended for a standard RGB stripe pixel layout with equal size and/or luminance capability sub-pixels for each colour type, and modifies the input image data into output image data before output to the display by detecting for each 3×3 block of pixels in the image whether the arrangement of intended luminances for the pixels of the block for each colour channel separately, match one of the zero resolution loss patterns or not. If the input data is a fit to one of the patterns, the data may then be sent to the display unmodified, as although the luminance produced by the sub-pixel which are smaller than the $\frac{1}{3}^{rd}$ pixel area expected by the data will appear too dim, this will be balanced by the excess luminance produced by the larger sub-pixel of the group. If the input data is not a fit to one of the zero resolution loss patterns, then the image data may be modified into output image data so as to transfer luminance intended for a sub-pixel which is too small to display it, to a neighbouring sub-pixel of the same colour type, or reduce the gradation level applied to a larger sub-pixel if it would produce a luminance in excess of that specified by the input data due to its greater than expected size. This transfer or modification of the luminance specified for each sub-pixel by the input image data may be performed in such a way as to minimise the resolution loss incurred by the modification, as perceived by a viewer.

A more rigorous and adaptable version of the image data modification process may also process each 3×3 block of pixels in the input image data, separately for each colour channel, and adapt the input image data values for all sub-pixels according to their size or luminance capability, relative to that expected by the input image data. It may then redistribute any luminance intended for a sub-pixel which is smaller than expected by the input image data to a neighbouring larger sub-pixel of the same colour type, according to which of the seven zero-resolution loss pattern the 3×3 block most closely matches.

Figure 10A:
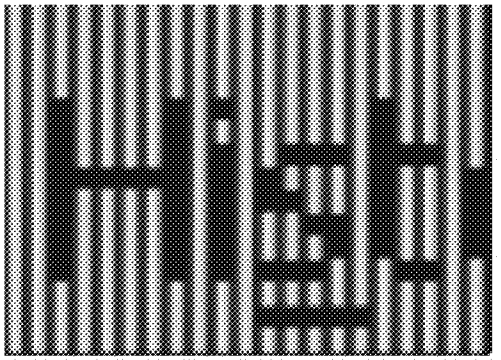
FIGS. 10(*a*)-10(*b*): are illustrations of how a single pixel width text image feature may be rendered on an RGB stripe display, and on a display in accordance with an exemplary embodiment of the present invention.
Figure 10B:
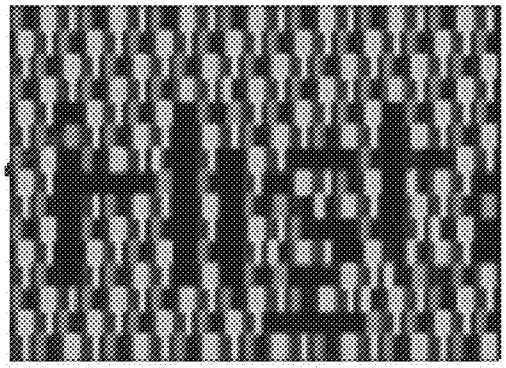

For the example of the pixel layout of FIG. 2, the input image data values may be gamma corrected to provide the intended luminance for each pixel (a typical display has a relationship between the input image data value (D) and the luminance (L) produced by a pixel addressed with that value of $L=(D/D_{max})^{2.2}$, where $D_{max}$ is the maximum input data value (255 in an 8 bit display) and the value of the raising power is known as the gamma value (i.e. a gamma 2.2 display), and then the smallest sub-pixels may have this luminance multiplied by a factor of 7/3 to account for the pixel being 1/7 of the white pixel area instead of the of the expected 1/3 size. The medium sized pixels may have this luminance multiplied by 7/6, to account for having a 2/7 pixel area instead of the expected 1/3. Correspondingly, the larger sized sub-pixels may have their input luminance value multiplied by a factor of 7/12, to account for their area being 4/7 of the white pixel, rather than the expected 1/3. Any of the smaller pixels having a modified luminance after this scaling greater than 1, may then have the excess passed to the neighbouring medium or larger sized sub-pixel in the direction indicated by the zero resolution loss pattern which the 3×3 block most closely matches, and the transferred excess will then again be scaled according the relative size of the sub-pixel (i.e. multiplied by a factor of 1/2 if being passed to a medium sized sub-pixel, and scaled by a factor of 1/4 if being passed to a large sub-pixel). Likewise, any medium sized pixel having a modified luminance after this scaling greater than 1, may then have the excess passed to the neighbouring larger sized sub-pixel in the direction indicated by the zero resolution loss pattern which the 3×3 block most closely matches, and the transferred excess will then again be scaled according the relative size of the sub-pixels (i.e. multiplied by a factor of 1/2). After the luminance scaling and transfer process, these modified luminance values ($L_{mod}$) may then be reverse gamma corrected, in order to return the pixel value to the 8 bit, gamma scaled data expected by the display, using the inverse of the previous equation ($D=(L_{mod})^{1/2.2}\times D_{max}$). The result of a process of this embodiment operating of sample image input data with single pixel width black text on a yellow background is illustrated in FIG. 10. This shows clearly the fine resolution features are reproduced in the new pixel layout panel, although with some blurring to prevent noticeable colour defects at feature edges.

A simpler version of the image data modification process, which requires the storage of fewer input image pixel data values and no pattern matching process, may process each sub-pixel individually, rather than in 3×3 blocks, and row-wise fashion from left-to-right across the image. This process may calculate the modified luminances for each sub-pixel using the same scaling values as the previous embodiment, but for the small sub-pixels, any excess luminance may be divided by 2, and passed equally to the medium sized sub-pixels immediately to its right and below (and again scaled for the transfer to account for the change in pixel size). Likewise, for each medium sized sub-pixel, any excess luminance (including that which it may have received form a previously process small sub-pixel) may be divided by 2, and passed equally to the large sized sub-pixels immediately to its right and below (and again scaled for the transfer to account for the change in pixel size). In this way, the process applied to all sub-pixels is identical (convert data to luminance, scale according to pixel size, divide any excess greater than 1 by 4 to account for it being passed equally to two neighbouring sub-pixels, each of which is twice the size of the source sub-pixel), and then re-convert modified luminance back to data. This method may not perfectly preserve the effective resolution of image features matching some of the zero resolution loss patterns, but the increased effective resolution loss in these cases may be considered acceptable given the simplicity of the process.

While the above embodiments have been described for simplicity as applying to transmissive type LCDs, it is not limited to application in these devices. It will be obvious that the advantages of the novel pixel layouts described herein will also obtained when applied to other LCD types such as reflective and transflective, and other non-LCD display types, such as, but not limited to, OLED and other emissive technologies. In these cases, the general relationships in the way the input image data is modified to account for the discrepancy between the pixel size or emissive luminance capability of the display, and that expected by the image data format, may be adjusted to the specifics of the display without constituting an inventive step. Other image data modification processes which account for this discrepancy, and format the input data for the novel pixel layout with minimal impact on the perceived image quality, or loss of effective resolution are also possible, and should be considered within the scope of this invention. Additionally, while the embodiments above have been described for consistency and with comparison to the common RGB stripe pixel layout, it will also be obvious that the advantages of the invention may be gained by modifying displays with other pixel layouts having sub-pixels of the same colour type of only one size or luminance capability, to have multiple sizes or luminance capability for sub-pixels of a given colour type, including displays with 4 or more sub-pixel colour types. Additionally, while the above embodiments have been described for simplicity as providing three different sizes or luminance capabilities for each sub-pixel colour type, two, four, or more different sizes could be provided while remaining within the scope of the invention.

The various embodiments also have been described principally in connection with providing different luminance capability by adjusting the area of the sub-pixel colour types in different composite pixels. It is also contemplated that in certain types of displays, such as for example an emissive type display (e.g. OLED), the sub-pixels may be the same size still, but still have different maximum luminance capability in different composite pixels based on a sub-pixel property other than area. As long as the number of intermediate emission gradation levels is still fixed, the advantages remain. For example, in an exemplary embodiment there could be three pixels of the same size, but if the maximum emission from each is scaled to luminance ratio 1, 2 and 4 respectively, such that each sub-pixel has 256 possible gradations between its minimum and maximum emission, the schemes described and advantages gained are the same.

As aspect of the invention, therefore, is a color display. In exemplary embodiments, the color display includes a plurality of composite pixels, each composite pixel comprising sub-pixels of more than one color type. Sub-pixels of at least one of the color types are provided with differing luminance capability in different composite pixels. The color display may include one or more of the following features, either individually or in combination.

In an exemplary embodiment of the color display, each composite pixel comprises red, green and blue sub-pixels, the sub-pixels of a given colour type having different luminance capability in different composite pixels.

In an exemplary embodiment of the color display, the differing luminance capability is achieved by providing sub-pixels of at least one of the color types of differing relative area in different composite pixels.

In an exemplary embodiment of the color display, each composite pixel comprises red, green and blue sub-pixels, the sub-pixels of a given colour type in groups of three neighbouring pixels having relative areas of area ratio 1, 2 and 4.

In an exemplary embodiment of the color display, each composite pixel is provided with one sub-pixel of each of the colour types, and one sub-pixel of each of the relative areas, such that each composite pixel has a same total area.

In an exemplary embodiment of the color display, the color display further includes an image data processing unit (IDPU). The IDPU is configured to: receive input image data of a standard format; modify the input image data into output image data to account for a discrepancy between the luminance capability of each sub-pixel and a luminance capability for each sub-pixel as expected based on the input image data; and output the output image data to control the plurality of the composite pixels.

In an exemplary embodiment of the color display, the IDPU is configured to modify the input image data by: processing groups of pixels in the input image data corresponding to the smallest repeating unit of the pixel pattern of the display together; matching the pattern pixel luminances in the group specified by the input image data to the closest of a set of zero effective resolution loss patterns; and transferring luminance between sub-pixels to account for the luminance discrepancy in a manner informed by the result of the pattern matching.

In an exemplary embodiment of the color display, the IDPU is configured to modify the input image data by: processing sub-pixels individually and in sequence; transferring excess luminance from lower luminance sub-pixel types to their immediate neighbour larger luminance sub-pixel types which are yet to be processed in the sequence, in a manner which accounts for both the discrepancy in the luminance capability of each sub-pixel, and in relative luminance capability of the sub-pixels between which luminance is transferred.

In an exemplary embodiment of the color display, the IDPU is configured to: receive input image data of a standard format; modify the input image data into output image data to account for a discrepancy between the luminance capability based on the differing size of each sub-pixel and a luminance capability for each sub-pixel as expected based on the input image data; and output the output image data to control the plurality of the composite pixels.

In an exemplary embodiment of the color display, the IDPU is configured to modify the input image data by: processing groups of pixels in the input image data corresponding to the smallest repeating unit of the pixel pattern of the display together; matching the pattern pixel luminances in the group specified by the image data to the closest of a set of zero effective resolution loss patterns; and transferring luminance between sub-pixels to account for the luminance discrepancy based on the differing size in each sub-pixel in a manner informed by the result of the pattern matching.

In an exemplary embodiment of the color display, the IDPU is configured to modify the input image data by: processing sub-pixels individually and in sequence; and transferring excess luminance from smaller area sub-pixel types to their immediate neighbour larger area sub-pixel types which are yet to be processed in the sequence, in a manner which accounts for both the discrepancy in the luminance capability based on the relative size of each sub-pixel, and in a relative size of the sub-pixels between which luminance is transferred.

Another aspect of the invention is a method of processing image data in a color display. In exemplary embodiments, the method of processing image data includes the steps of: providing a plurality of composite pixels, each composite pixel comprising sub-pixels of more than one color type, and sub-pixels of at least one of the color types are provided with differing luminance capability in different composite pixels; receiving in an image data processing unit (IDPU) input image data of a standard format; modifying the input image data with the IDPU into output image data to account for a discrepancy between the luminance capability of each sub-pixel and a luminance capability for each sub-pixel as expected based on the input image data; and outputting the output image data from the IDPU to control the plurality of the composite pixels. The method of processing image data may include one or more of the following features, either individually or in combination.

In an exemplary embodiment of the method of processing image data, the IDPU modifies the input image data by: processing groups of pixels in the input image data corresponding to the smallest repeating unit of the pixel pattern of the display together; matching the pattern pixel luminances in the group specified by the input image data to the closest of a set of zero effective resolution loss patterns; and transferring luminance between sub-pixels to account for the luminance discrepancy in a manner informed by the result of the pattern matching step.

In an exemplary embodiment of the method of processing image data, the IDPU modifies the input image data by: processing sub-pixels individually and in sequence; and transferring excess luminance from lower luminance sub-pixel types to their immediate neighbour larger luminance sub-pixel types which are yet to be processed in the sequence, in a manner which accounts for both the discrepancy in the luminance capability of each sub-pixel, and in relative luminance capabilities of the sub-pixels between which luminance is transferred.

In an exemplary embodiment of the method of processing image data, the IDPU modifies the input image data into the output image data to display the output image data with an improved wide-view performance in comparison to a display of the input image data, and the input image and the output image data have a same number of applicable luminance gradation values to each sub-pixel, but the input image data having all sub-pixels of a given colour type being of the same luminance capability.

In an exemplary embodiment of the method of processing image data, the differing luminance capability is achieved by providing sub-pixels of at least one of the color types of differing relative area in different composite pixels.

In an exemplary embodiment of the method of processing image data, the IDPU modifies the input image data by: processing groups of pixels in the input image data corresponding to the smallest repeating unit of the pixel pattern of the display together; matching the pattern pixel luminances in the group specified by the image data to the closest of a set of zero effective resolution loss patterns; and transferring luminance between sub-pixels to account for the luminance discrepancy based on the differing size in each sub-pixel in a manner informed by the result of the pattern matching.

In an exemplary embodiment of the method of processing image data, the IDPU modifies the input image data by: processing sub-pixels individually and in sequence; and transferring excess luminance from smaller area sub-pixel types to their immediate neighbour larger area sub-pixel types which are yet to be processed in the sequence, in a manner which accounts for both the discrepancy in the luminance capability based on the relative size of each sub-pixel, and in a relative size of the sub-pixels between which luminance is transferred.

In an exemplary embodiment of the method of processing image data, the IDPU modifies the input image data into the output image data to display the output image data with an improved wide-view performance in comparison to a display of the input image data, and the input image and the output image data have a same number of applicable luminance gradation values to each sub-pixel, but the input image data having all sub-pixels of a given colour type being of the same relative area.

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

INDUSTRIAL APPLICABILITY

The embodiments of this invention are applicable to many display devices, and a user may benefit from the capability of the display to produce both high bit depth and improved wide-view. Examples of such devices include mobile phones, Personal Digital Assistants (PDAs), tablet and laptop computers, desktop monitors, Automatic Teller Machines (ATMs), automotive displays and Electronic Point of Sale (EPOS) equipment.

The invention claimed is:

1. A color display comprising:

a plurality of composite pixels, each composite pixel comprising sub-pixels of more than one color type;

wherein sub-pixels of at least one of the color types are provided with differing luminance capability in different composite pixels; and further comprising an image data processing unit (IDPU), and the IDPU is configured to:

receive input image data of a standard format;

modify the input image data into output image data to account for a discrepancy between the luminance capability of each sub-pixel and a luminance capability for each sub-pixel as expected based on the input image data; and output the output image data to control the plurality of the composite pixels;

wherein the IDPU is configured to modify the input image data by:

processing groups of pixels in the input image data corresponding to the smallest repeating unit of the pixel pattern of the display together;

matching the pattern pixel luminances in the group specified by the input image data to the closest of a set of zero effective resolution loss patterns; and transferring luminance between sub-pixels to account for the luminance discrepancy in a manner informed by the result of the pattern matching.

2. A color display comprising:

a plurality of composite pixels, each composite pixel comprising sub-pixels of more than one color type;

wherein sub-pixels of at least one of the color types are provided with differing luminance capability in different composite pixels; and further comprising an image data processing unit (IDPU), and the IDPU is configured to:

receive input image data of a standard format;

modify the input image data into output image data to account for a discrepancy between the luminance capability of each sub-pixel and a luminance capability for each sub-pixel as expected based on the input image data; and output the output image data to control the plurality of the composite pixels;

wherein the IDPU is configured to modify the input image data by:

processing sub-pixels individually and in sequence;

transferring excess luminance from lower luminance sub-pixel types to their immediate neighbour larger luminance sub-pixel types which are yet to be processed in the sequence, in a manner which accounts for both the discrepancy in the luminance capability of each sub-pixel, and in relative luminance capability of the sub-pixels between which luminance is transferred.

3. A color display comprising:

a plurality of composite pixels, each composite pixel comprising sub-pixels of more than one color type;

wherein sub-pixels of at least one of the color types are provided with differing luminance capability in different composite pixels;

wherein the differing luminance capability is achieved by providing sub-pixels of at least one of the color types of differing relative area in different composite pixels; and further comprising an image data processing unit (IDPU), and the IDPU is configured to:

receive input image data of a standard format;

modify the input image data into output image data to account for a discrepancy between the luminance capability based on the differing size of each sub-pixel and a luminance capability for each sub-pixel as expected based on the input image data; and output the output image data to control the plurality of the composite pixels;

wherein the IDPU is configured to modify the input image data by:

processing groups of pixels in the input image data corresponding to the smallest repeating unit of the pixel pattern of the display together;

matching the pattern pixel luminances in the group specified by the image data to the closest of a set of zero effective resolution loss patterns; and transferring luminance between sub-pixels to account for the luminance discrepancy based on the differing size in each sub-pixel in a manner informed by the result of the pattern matching.

4. A color display comprising:

a plurality of composite pixels, each composite pixel comprising sub-pixels of more than one color type;

wherein sub-pixels of at least one of the color types are provided with differing luminance capability in different composite pixels;

wherein the differing luminance capability is achieved by providing sub-pixels of at least one of the color types of differing relative area in different composite pixels; and further comprising an image data processing unit (IDPU), and the IDPU is configured to:

receive input image data of a standard format;

modify the input image data into output image data to account for a discrepancy between the luminance capability based on the differing size of each sub-pixel and a luminance capability for each sub-pixel as expected based on the input image data; and output the output image data to control the plurality of the composite pixels;

wherein the IDPU is configured to modify the input image data by:

processing sub-pixels individually and in sequence; and transferring excess luminance from smaller area sub-pixel types to their immediate neighbour larger area sub-pixel types which are yet to be processed in the sequence, in a manner which accounts for both the discrepancy in the luminance capability based on the relative size of each sub-pixel, and in a relative size of the sub-pixels between which luminance is transferred.

* * * * *